US007430884B2

(12) United States Patent
Laithwaite

(10) Patent No.: US 7,430,884 B2
(45) Date of Patent: Oct. 7, 2008

(54) WASHING MACHINE WITH OZONE SENSOR

(75) Inventor: John Laithwaite, Ripponden (GB)

(73) Assignees: JLA Limited, Ripponden (GB); Daniels Equipment Company, Auburn, NH (US)

( * ) Notice: Subject to any disclaimer, the term of this patent is extended or adjusted under 35 U.S.C. 154(b) by 579 days.

(21) Appl. No.: 11/010,616

(22) Filed: Dec. 13, 2004

(65) Prior Publication Data

US 2005/0268404 A1 Dec. 8, 2005

(30) Foreign Application Priority Data

Jun. 4, 2004 (GB) ..... 0412496.2

(51) Int. Cl.
*D06F 39/02* (2006.01)
*D06F 33/02* (2006.01)

(52) U.S. Cl. ..... 68/12.02; 68/12.12; 68/12.27; 68/207

(58) Field of Classification Search ..... 68/12.05, 68/12.12, 12.18, 12.23, 12.27, 13 R, 17 R, 68/207
See application file for complete search history.

(56) References Cited

U.S. PATENT DOCUMENTS

| | | | | |
|---|---|---|---|---|
| 5,404,732 | A | 4/1995 | Kim | |
| 5,625,915 | A | 5/1997 | Radler et al. | 8/158 |
| 5,688,289 | A | 11/1997 | Nishioka et al. | |
| 5,806,120 | A | 9/1998 | McEachern | 8/158 |
| 5,960,501 | A | 10/1999 | Burdick | |
| 5,960,649 | A | 10/1999 | Burdick | 68/12.12 |
| 6,006,387 | A * | 12/1999 | Cooper et al. | 8/158 |
| 6,408,471 | B1 * | 6/2002 | Teran et al. | 8/158 |
| 6,418,580 | B1 * | 7/2002 | Teran et al. | 8/158 |
| 6,507,965 | B2 | 1/2003 | Kown | 8/158 |
| 6,598,431 | B2 * | 7/2003 | Teran et al. | 68/17 R |
| 2006/0096038 | A1 * | 5/2006 | Daniels et al. | 8/158 |

FOREIGN PATENT DOCUMENTS

| | | |
|---|---|---|
| EP | 1138818 | 10/2001 |
| JP | 2003220292 | 8/2003 |

OTHER PUBLICATIONS

Search Report dated Mar. 3, 2005 for GB Patent Application No. 0410405.5.

* cited by examiner

*Primary Examiner*—Joseph L. Perrin
(74) *Attorney, Agent, or Firm*—Howard & Howard Attorneys, P.C.

(57) ABSTRACT

A washing machine includes a washing volume for receiving laundry. The washing machine also includes an ozone inlet for providing ozone to the washing volume and an ozone outlet for receiving gaseous ozone from the washing volume. An ozone sensor is provided for measuring the gaseous ozone passing through the ozone outlet. A controller may be connected to the ozone sensor to receive an ozone measurement and to determining a degree of disinfection by the washing cycle.

9 Claims, 2 Drawing Sheets

WASHING MACHINE WITH OZONE SENSOR

Figure 1:
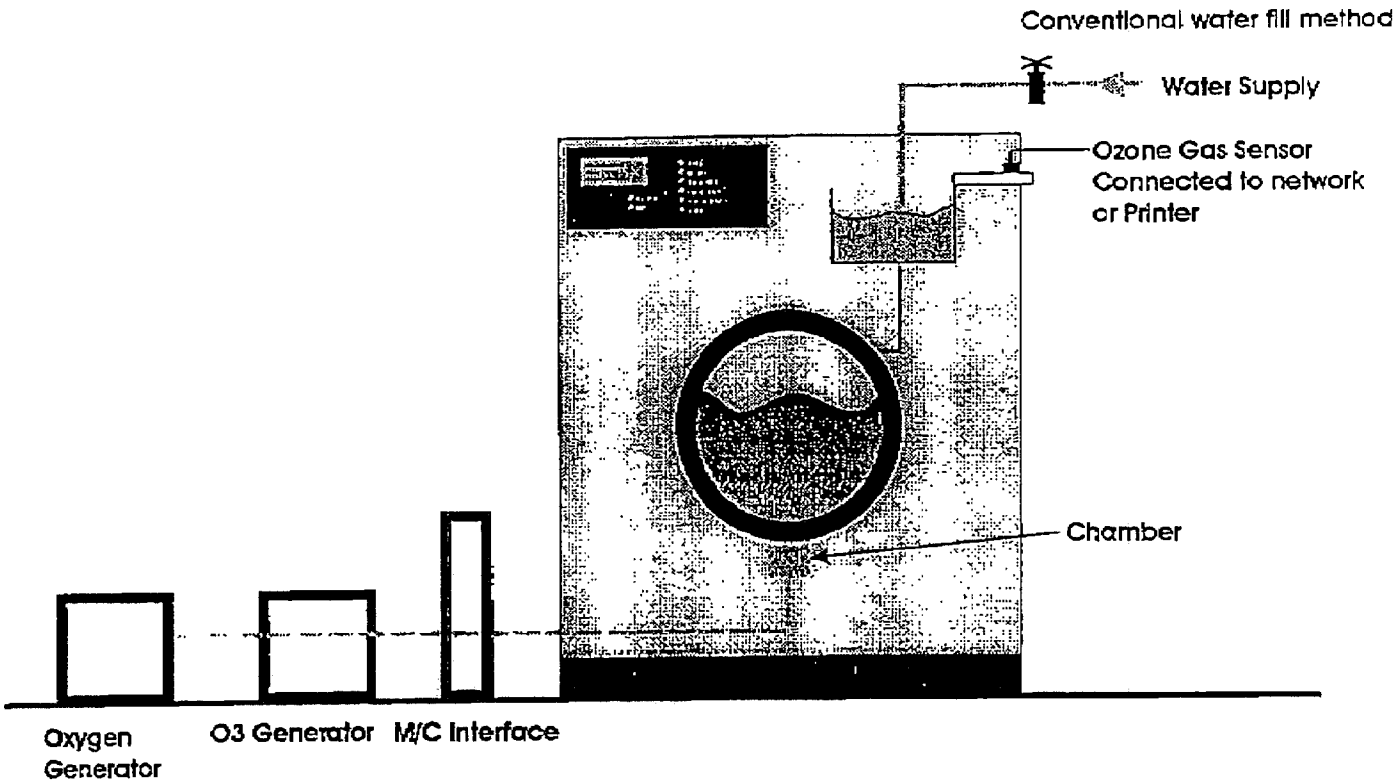

The present invention relates to a washing machine and a method of washing. More particularly, but not exclusively, the present invention relates to a washing machine comprising an ozone sensor for measuring gaseous ozone not dissolved in the water in the washing machine and a method of determining the degree of disinfection of laundry in the washing machine from such measurements.

It is known to introduce ozone into washing water in a washing machine during a washing cycle. The ozone disinfects the washing, reducing washing time and also reducing the amount of detergent required.

When ozone is first dissolved in washing water the ozone concentration is rapidly reduced due to the effect of bacteria and soiling. Since the degree of ozone depletion can vary between washing loads it is difficult to determine the amount of ozone required. This can result in over use of ozone increasing washing expense or alternatively inadequate disinfection of laundry.

Accordingly, in a first aspect, the present invention provides a washing machine comprising:

a washing volume for receiving laundry;

an ozone inlet for providing ozone to the washing volume; and an ozone outlet for receiving gaseous ozone from the washing volume characterised in that the washing machine further comprises an ozone sensor for measuring the gaseous ozone received by the ozone outlet.

The washing machine according to the invention has the advantage that it can be used to confirm the degree of disinfection of the laundry in the washing machine so confirming the laundry is sufficiently disinfected.

The ozone sensor can be located within the washing volume, preferably proximate to the ozone outlet.

The measurement made by the ozone sensor will be related to the ozone concentration in the washing volume and hence the ozone bubbling through the washing liquid.

Preferably, the washing machine further comprises a controller adapted to receive at least one ozone measurement from the ozone sensor during a washing cycle to determine the degree of disinfection by the laundry washing cycle.

The washing cycle can comprise at least two rinse stages and the at least one ozone measurement is made daring the second rinse stage.

The controller can be adapted to receive a plurality of ozone measurements from the ozone sensor during the second rinse cycle to determine the degree of disinfection of laundry by the washing cycle.

Preferably, the controller is adapted to receive ozone measurements from the start and the end of the second rinse cycle.

The washing machine can further comprise a display device connected to the controller for displaying the ozone measurements received by the controller.

The display device can comprises at least one of a printer or monitor.

Preferably the washing machine can further comprise computation means connected to the controller for determining the degree of disinfection of the laundry from the ozone measurement received by the controller.

The computation means can be adapted to compare the ozone measurements with predetermined values to determine the degree of disinfection of the laundry.

The computation means can be adapted to produce a pass or a fail signal depending upon the determined degree of disinfection of the laundry.

The washing machine can further comprise a lock out mechanism for preventing further use of the washing machine, the lock out mechanism being connected to the computation means and being adapted to be activated on receipt of a fail signal from the computation means.

In a further aspect of the invention there is provided a method of washing comprising the steps of (i) providing a washing machine comprising:

a washing volume for receiving laundry, an ozone inlet for providing ozone to the washing volume; and an ozone outlet for receiving gaseous ozone from the washing volume characterised in that the washing machine farther comprises an ozone sensor for measuring the ozone received by the ozone outlet;

(ii) commencing a washing cycle (iii) measuring the concentration of ozone gas with the ozone sensor at at least one point during the washing cycle; and (iv) determining the degree of disinfection of laundry in the washing machine from the at least one measurement of ozone concentration The method of washing according to the invention enables the degree of disinfection of the laundry to be determined so increasing washing reliability.

Preferably, the washing cycle comprises at least two rinse cycles, and the at least one ozone measurement is made during the second rinse cycle.

The ozone concentration can be measured at the start and end of the second rinse cycle.

Preferably the step of determining the degree of disinfection comprises the step of comparing the at least one ozone measurement with at least one predetermined value.

Preferably the method of washing further comprises the step of locking out the washing machine to prevent further use of the washing machine if the degree if disinfection does not meet a predetermined level.

Figure 2:
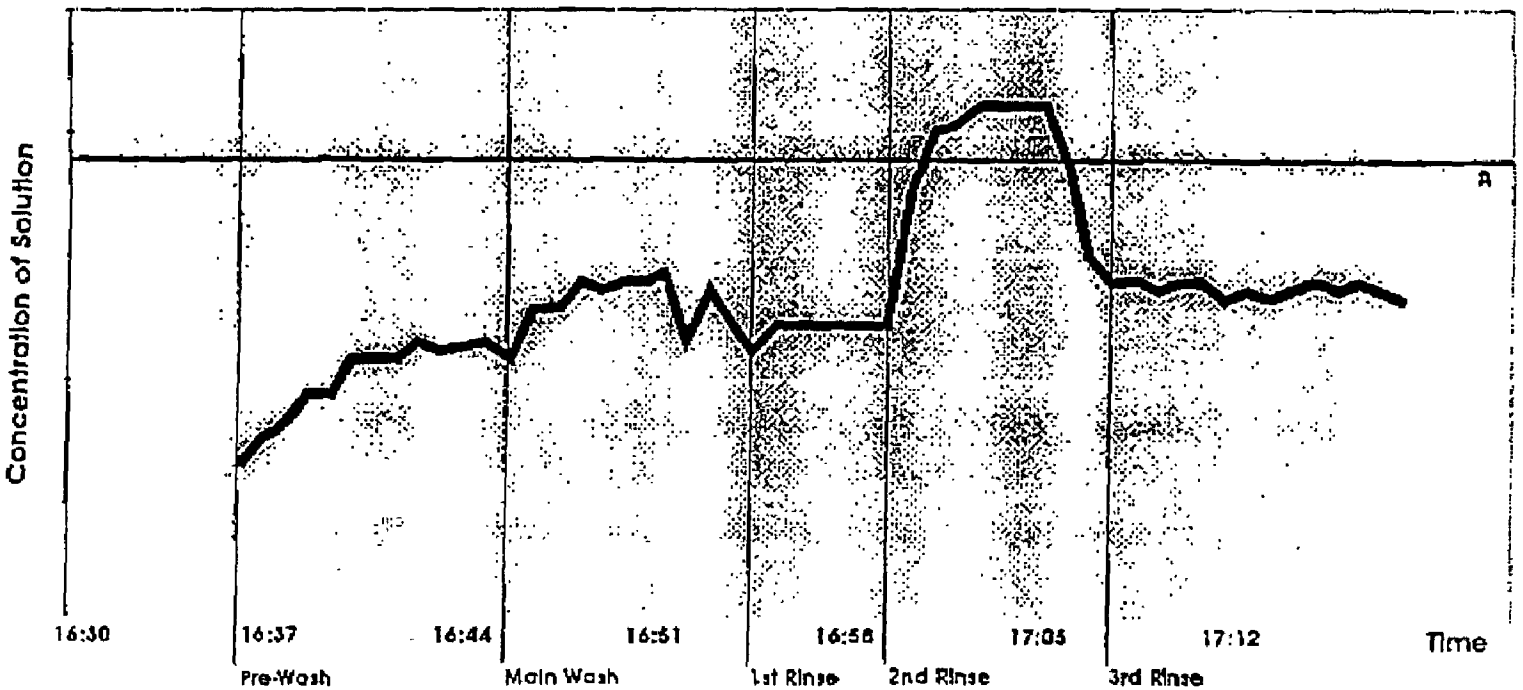

The present invention will now be described by way of example only and not in any limitative sense with reference to the accompanying drawings in which FIG. 1 shows a schematic view of a washing machine according to the invention; and FIG. 2 shows a graph of ozone concentration measured by an ozone sensor of a washing machine according to the invention against time during a washing cycle.

FIG. 1 shows a washing machine according to the invention. The washing machine comprises a washing volume split into a main washing volume and a mixing chamber below the main washing volume and in fluid communication therewith. A laundry drum for receiving laundry is contained in the main washing volume.

The mixing chamber contains a sparger connected to an ozone generator via an ozone inlet The washing machine also comprises an ozone outlet through which gaseous ozone leaves the washing volume.

The washing machine further comprises an ozone sensor within the washing volume arranged to measure the concentration of ozone gas passing through the ozone outlet. The ozone sensor is connected to a controller (not shown) for receiving measurements from the sensor. Connected to the controller is a printer for printing the measurements.

In use laundry is inserted into the laundry drum and a wash cycle commenced. During the wash cycle ozone flows from the ozone source through the sparger and mixing chamber to the main washing volume.

Any ozone which is not dissolved in the washing water bubbles through the water and out of the washing volume via the ozone outlet. The concentration of ozone passing through the ozone outlet is related to concentration of ozone dissolved in the washing water. A low flow of ozone gas through the outlet indicates that a large percentage of the ozone being provided by the sparger is being dissolved in the water suggesting a low ozone concentration in the water due to bacterial action and/or soiling. Conversely, a high flow of ozone gas through the ozone outlet indicates little ozone is being dissolved in the water which is saturated with ozone due to little bacterial/soiling activity.

The wash cycle comprises two rinse stages. The second rinse stage is consecutive to the first so during the second stage the rinse water should contain very little dissolved detergent.

Shown in FIG. 2 is a plot of concentration of ozone dissolved in the washing water (related to the ozone concentration measured by the ozone sensor) against time for a wash cycle. As can be seen during the wash cycle the ozone concentration vanes depending on the rate of flow of ozone into the washing machine and also the degree of bacterial action of the laundry. During the second rinse stage the ozone concentration of ozone dissolved in the water is closely linked to the degree of bacterial action. A high ozone concentration during this stage suggests low bacterial concentration and hence effective disinfection of the washing.

During the second rinse stage a measurement is made of the ozone gas concentration by the ozone sensor. The measurement is received by the controller and then passed to the printer for manual review.

In an alternative embodiment of the invention measurements are made of the ozone gas concentration both at the start and the end of the second rinse stage. These are again passed to the printer for manual review.

In a further alternative embodiment several concentration measurements are made during the second rinse stage and passed to the printer for printing for manual review.

Once the measurements have been passed to the printer they are manually compared to predetermine ozone concentration levels. If the measure levels are above the predetermined levels then the laundry is considered to have been sufficiently disinfected. Alternatively, if the measure levels are below the predetermined levels then it may be necessary to rewash the laundry.

In a further embodiment of the invention (not shown) the controller is connected to a computer which automatically compares the measured ozone levels to the predetermined levels. The computer generates a pass or fail signal depending on the comparison. The signal is printed as a receipt.

In a further embodiment of the invention the washing machine comprises a lockout mechanism connected to the computer. On receipt of a fail signal from the computer the lock out mechanism prevents further use of the washing machine until the lockout mechanism is manually reset. The washing machine of this further embodiment comprises a further ozone sensor measuring the ozone in the environment surrounding the washing machine. The ozone sensor is connected to the computer. If the ozone concentration measured by the by this secondary ozone sensor exceeds a predetermined limit the computer sends the fail signal to the lockout mechanism.

In an alternative embodiment of the invention the further ozone sensor is connected directly to the lockout mechanism.

In a further embodiment of the invention the washing machine comprises a data logger for logging ozone measurements for later analysis. The washing machine of this embodiment of the invention can be connected to a remote communications network allowing remote interrogation of the washing machine data In a further embodiment of the invention the ozone sensor makes measurements throughout the washing cycle however only the measurements made in the second rinse stage are used to determine the degree of disinfection of the laundry.

In a further embodiment of the invention the ozone sensor is proximate to the ozone outlet. In an alternative embodiment the ozone sensor is remote from the ozone outlet. In both cases the ozone sensor measures the ozone concentration in the washing volume which can be correlated to the ozone flow through the ozone outlet.

In a further embodiment of the invention the ozone sensor in the washing volume is also connected to the lockout mechanism. If the ozone concentration within the washing volume exceeds a predetermined level then the lockout mechanism is activated preventing further use of the washing machine until the lockout mechanism is reset.

In an alternative embodiment the computer issues a fail signal to the lockout mechanism when the ozone concentration measured by the ozone sensor within the washing volume exceeds a predetermined value.

The invention claimed is:

1. A washing machine comprising:

a washing volume for receiving laundry;

an ozone inlet for providing ozone to the washing volume;

an ozone outlet for receiving gaseous ozone from the washing volume;

an ozone sensor proximate to the ozone outlet for measuring the gaseous ozone passing through the ozone outlet: and a controller connected to the ozone sensor to receive at least one ozone measurement from the ozone sensor during a washing cycle and to determine a degree of disinfection by the washing cycle, wherein the washing cycle comprises at least two rinse stages and the at least one ozone measurement is made during a second rinse stage;

wherein said washing volume includes a gaseous section and a washing water section with said ozone outlet in fluid communication with said gaseous section for receiving the gaseous ozone from the washing volume.

2. A washing machine as claimed in claim 1, wherein the controller is adapted to receive a plurality of ozone measurements from the ozone sensor during the second rinse cycle to determine the degree of disinfection of laundry by the washing cycle.

3. A washing machine as claimed in claim 1, wherein the controller is adapted to receive ozone measurements from the start and the end of the second rinse cycle.

4. A washing machine as claimed in claim 1, further comprising a display device connected to the controller for displaying the ozone measurements received by the controller.

5. A washing machine as claimed in claim 4, wherein the display device comprises at least one of a printer or monitor.

6. A washing machine as claimed in claim 1 comprising computation means connected to the controller for determining the degree of disinfection of the laundry from the ozone measurement received by the controller.

7. A washing machine as claimed in claim 6 wherein the computation means is adapted to compare the ozone measurements with predetermined values to determine the degree of disinfection of the laundry.

8. A washing machine as claimed in claim 6 wherein the computation means is adapted to produce a pass or a fail signal depending upon the determined degree of disinfection of the laundry.

9. A washing machine as claimed in claim 8 further comprising a lock out mechanism for preventing further use of the washing machine, the lock out mechanism being connected to the computation means and being adapted to be activated on receipt of a fail signal from the computation means.

* * * * *